US010443328B2

(12) United States Patent
Culen

(10) Patent No.: US 10,443,328 B2
(45) Date of Patent: Oct. 15, 2019

(54) MANAGED PRESSURE DRILLING SYSTEM WITH INFLUX CONTROL

(71) Applicant: Martin Culen, Dubai (AE)

(72) Inventor: Martin Culen, Dubai (AE)

( * ) Notice: Subject to any disclaimer, the term of this patent is extended or adjusted under 35 U.S.C. 154(b) by 544 days.

(21) Appl. No.: 15/259,792

(22) Filed: Sep. 8, 2016

(65) Prior Publication Data

US 2017/0356259 A1 Dec. 14, 2017

Related U.S. Application Data

(60) Provisional application No. 62/349,194, filed on Jun. 13, 2016.

(51) Int. Cl.
*E21B 21/08* (2006.01)
*E21B 21/10* (2006.01)
(Continued)

(52) U.S. Cl.
CPC ..... *E21B 21/08* (2013.01); *E21B 21/106* (2013.01); *E21B 44/00* (2013.01); *E21B 47/042* (2013.01); *E21B 2021/006* (2013.01)

(58) Field of Classification Search
CPC .. E21B 2021/006; E21B 21/08; E21B 21/106; E21B 44/00; E21B 47/042
See application file for complete search history.

(56) References Cited

U.S. PATENT DOCUMENTS 7,027,968 B2 * 4/2006 Choe ..... E21B 21/001 175/60
7,367,411 B2 * 5/2008 Leuchtenberg ..... E21B 21/08 166/53
(Continued)

FOREIGN PATENT DOCUMENTS

EP 1485574 B1 11/2007
WO 2013006165 A1 1/2013
WO 2016040310 A1 3/2016

OTHER PUBLICATIONS

M.S. Culen, P.R. Brand, W. Bacon, Q.R. Gabaldon, "Society of Petroleum Engineers (SPE)/ international Association of Drilling Contractors (IADC) Managed Pressure Drilling and Underbalarrced Operations Conference and Exhibition", Apr. 2016, Society of Petroleum Engineers (SPE)/ International Association of Drilling Contractors (IADC), Galveston, Texas, US.
(Continued)

*Primary Examiner* — Daniel P Stephenson
(74) *Attorney, Agent, or Firm* — Black, McCuskey, Souers & Arbaugh LPA

(57) ABSTRACT

A method of controlling an influx in a petroleum well with a managed pressure drilling system can include directing mud into the well; regulating a pressure of the mud proximate to a surface of the well with a choke valve; detecting, with a computing device having one or more processors, an intrusion of the influx in the well; increasing, in response to the detecting, the pressure of the mud proximate to the surface to a first level of surface back pressure by controlling the choke valve; determining, with the computing device, a volume of the influx; ascertaining an intrusion depth substantially concurrent with the detecting; and evacuating the influx in response to a correlation between both of the first level of surface back pressure and the volume of the influx relative to the intrusion depth.

20 Claims, 5 Drawing Sheets

(51) Int. Cl.

| | |
|---|---|
| ***E21B 44/00*** | (2006.01) |
| ***E21B 47/04*** | (2012.01) |
| *E21B 21/00* | (2006.01) |

(56) References Cited

U.S. PATENT DOCUMENTS

| | | | | |
|---|---|---|---|---|
| 8,307,913 | B2 * | 11/2012 | Dolman | E21B 21/003 175/38 |
| 8,517,111 | B2 | 8/2013 | Mix et al. | |
| 2003/0079912 | A1 | 5/2003 | Leuchtenberg | |
| 2003/0168258 | A1 * | 9/2003 | Koederitz | E21B 21/08 175/38 |
| 2007/0027036 | A1 * | 2/2007 | Polizzotti | C09K 8/02 507/143 |
| 2009/0272580 | A1 | 11/2009 | Dolman et al. | |
| 2009/0294174 | A1 | 12/2009 | Harmer et al. | |
| 2012/0241217 | A1 * | 9/2012 | Davis | E21B 44/00 175/26 |
| 2013/0327533 | A1 | 12/2013 | Veeningen | |
| 2014/0345940 | A1 | 11/2014 | Milner et al. | |
| 2017/0356259 | A1 * | 12/2017 | Culen | E21B 21/08 |

OTHER PUBLICATIONS

William Bacon, Catherine Sugden, Patrick Brand, Oscar Gabaldon, Martin Culen, "Society of Petroleum Engineers (SPE)/ International Association of Drilling Contractors (IADC) Managed Pressure Drilling and Underbalanced Operations Conference and Exhibition", Apr. 2016, Society of Petroleum Engineers (SPE)/ International Association of Drilling Contractors (IADC), Galveston, Texas, US.

Office Action, dated May 23, 2017, for corresponding European Application No. 16190834.8.

* cited by examiner

MANAGED PRESSURE DRILLING SYSTEM WITH INFLUX CONTROL

CROSS-REFERENCE TO RELATED APPLICATIONS

This application claims the benefit of United States Provisional Patent Application Ser. No. 62/349,194 for APPARATUS AND METHOD FOR MANAGED PRESSURED DRILLING WITH INFLUX MANAGEMENT, filed on 13 Jun. 2016, which is hereby incorporated by reference in its entirety.

BACKGROUND

1. Field

The present disclosure relates to generally to equipment utilized and operations performed in conjunction with a subterranean well and, more particularly, equipment and methods applied to and event detection.

2. Description of Related Prior Art

U.S. Pat. Pub. No. 20120241217 discloses a WELL DRILLING METHODS WITH AUTOMATED RESPONSE TO EVENT DETECTION. The well drilling method can include detecting a drilling event by comparing a parameter signature generated during drilling to an event signature indicative of the drilling event, and automatically controlling a drilling operation in response to at least a partial match resulting from comparing the parameter signature to the event signature. A well drilling system can include a control system which compares a parameter signature for a drilling operation to an event signature indicative of a drilling event, and a controller which controls the drilling operation automatically in response to the drilling event being indicated by at least a partial match between the parameter signature and the event signature.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A method of controlling an influx in a petroleum well with a managed pressure drilling system can include directing mud having a predetermined mud weight into the petroleum well with a mud pump. The method can also include regulating a pressure of the mud proximate to a surface of the petroleum well with a choke valve that is a component of the managed pressure drilling system. The method can also include detecting, with a computing device having one or more processors, an intrusion of the influx in the petroleum well. The method can also include increasing, in response to the detecting, the pressure of the mud proximate to the surface of the petroleum well to a first level of surface back pressure by controlling the choke valve. The method can also include determining, with the computing device, a volume of the influx. The method can also include ascertaining an intrusion depth of the petroleum well substantially concurrent with the detecting. The method can also include evacuating the influx from the petroleum well through the managed pressure drilling system in response to a correlation between both of the first level of surface back pressure and the volume of the influx relative to the intrusion depth.

BRIEF DESCRIPTION OF THE DRAWINGS

The detailed description set forth below references the following drawings.

DETAILED DESCRIPTION

Figure 1:
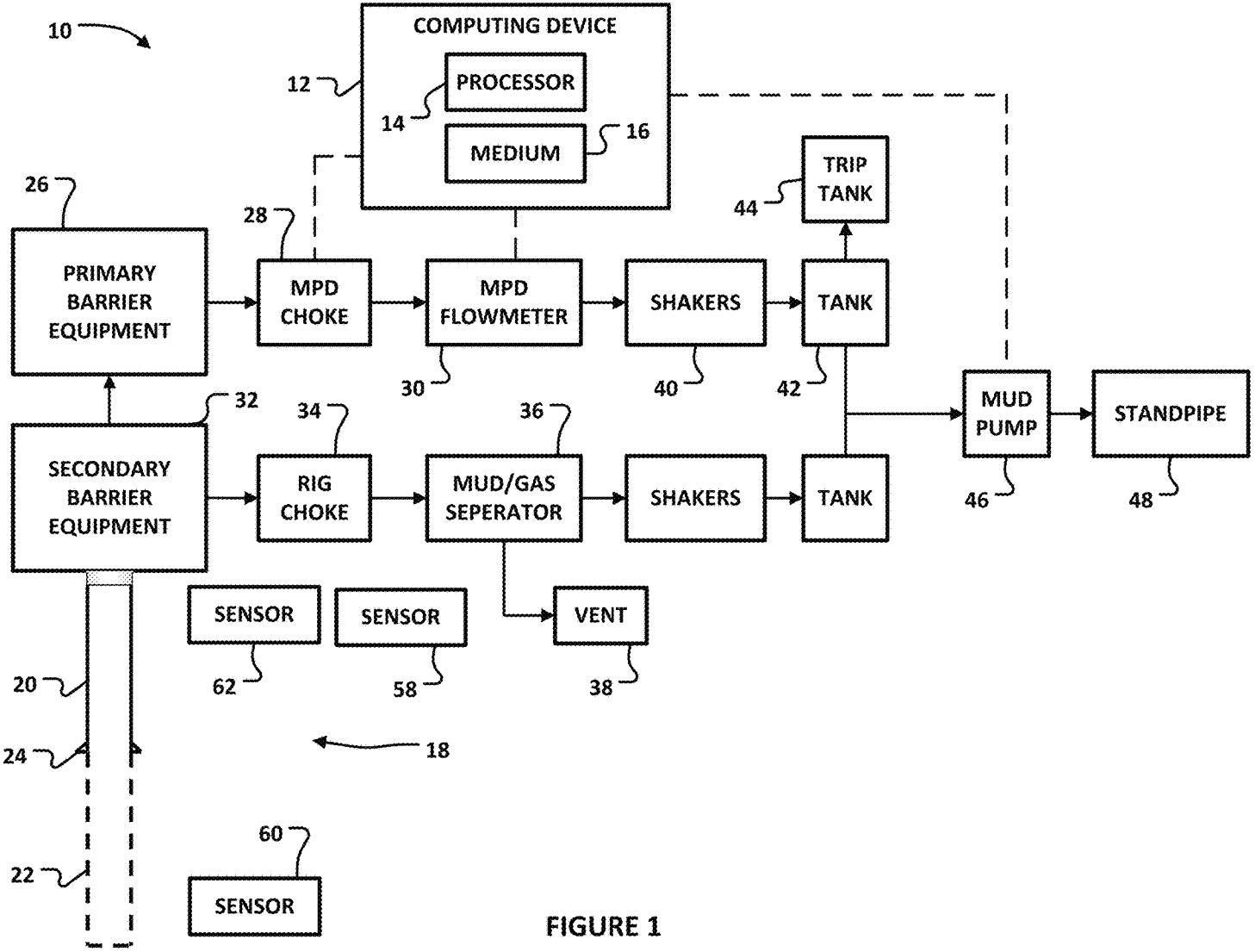
FIG. 1 is a schematic of a petroleum well and a managed pressure drilling system incorporating an exemplary embodiment of the present disclosure.

Referring now to FIG. 1, a managed pressure drilling system 10 is configured to control an influx in a petroleum well. Implementations of the managed pressure drilling system 10 can include a computing device 12. The computing device 12 has one or more processors 14 and a non-transitory, computer readable medium 16 storing instructions.

The managed pressure drilling system 10 can be positioned at a petroleum well 18. The petroleum well 18 can extend below the surface and can include a casing portion 20 and a hole portion 22. A shoe 24 is defined at the bottom of casing portion 20 and a top of the hole portion 22. Mud having a predetermined or known density can be pumped into the petroleum well 18 during drilling operations.

The processor 14 can be configured to control operation of the computing device 12. It should be appreciated that the term "processor" as used herein can refer to both a single processor and two or more processors operating in a parallel or distributed architecture. The processor 14 can operate under the control of an operating system, kernel and/or firmware and can execute or otherwise rely upon various computer software applications, components, programs, objects, modules, data structures, etc. Moreover, various applications, components, programs, objects, modules, etc. may also execute on one or more processors in another computing device coupled to processor 14, e.g., in a distributed or client-server computing environment, whereby the processing required to implement the functions of embodiments of the present disclosure may be allocated to multiple computers over a network. The processor 14 can be configured to perform general functions including, but not limited to, loading/executing an operating system of the computing device 12, controlling communication, and controlling read/write operations at the memory 18. The processor 14 can also be configured to perform specific functions relating to at least a portion of the present disclosure including, but not limited to, receive and assess signal inputs in accordance with instructions stored in medium 16 and control actuators in response to the signal inputs.

Memory or medium 16 can be defined in various ways in implementations of the present disclosure. Medium 16 can include computer readable storage media and communication media. Medium 16 can be non-transitory in nature, and may include volatile and non-volatile, and removable and non-removable media implemented in any method or technology for storage of information, such as computer-readable instructions, data structures, program modules or other data. Medium 16 can further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by the processor 16. Medium 16 can store computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

The managed pressure drilling system 10 can include primary barrier equipment 26 for evacuating an influx that has intruded in the petroleum well 18. In the field, the primary barrier equipment 26 may include, but not limited to, equipment such as a rotating rotary control device, pipes, and valves. An influx is defined by a gas, a liquid, or a mixture of gas and liquid. The influx can pass through the primary barrier equipment 26 to a choke valve 28. The choke valve 28 is controlled to selectively restrict the flow of fluid (gas and/or liquid) through the system.

Fluid can pass through the choke valve 28 to a flowmeter 30. The choke valve 28 and the flowmeter 30 can electronically communicate with the computing device 12. Control signals can be communicated to the choke valve 28 from the computing device 12, as schematically illustrated by a dashed line in FIG. 1. Data signals can be communicated to the computing device 12 from the flowmeter 30, as schematically illustrated by a dashed line in FIG. 1. The computing device 12 can emit control signals in to the choke valve 28 based on data signals received from the flowmeter 30, in accordance with programming stored on medium 16.

If it is decided by the operators of the petroleum well 18 that the influx is too large to be evacuated through the primary barrier equipment 26, the influx can be evacuated through secondary barrier equipment 32. The secondary barrier equipment 32 is more robust than the primary barrier equipment 26. The secondary barrier equipment 32 can include an annular blowout preventer and a ram blowout preventer. An influx evacuated through the secondary barrier equipment 32 can be directed through a rig choke 34 to a mud/gas separator 36. Gas can escape the mud/gas separator 36 through a vent 38.

Material passing out of the flowmeter 30 and the mud/gas separator 36 can be received in one or more shakers, such as shaker 40. Drilled cuttings are separated from mud in the shakers. The material can then be directed into one or more tanks, such as tank 42. Mud can be stored in the tanks and retrieved as necessary by one or more mud pumps, such as mud pump 46. The computing device 12 can control the mud pump 46 and can therefor determine the flow rate of mud into the petroleum well 18. The mud pumps can pump the mud to a standpipe 48, which is directed down into the petroleum well 18. Alternatively, a worker on the rig can control the mud pump 46 and the computing device 12 can receive signals from sensors corresponding to the flow rate of mud into the petroleum well 18.

A trip tank 44 is illustrated in FIG. 1. The trip tank 44 can be in fluid communication with the tank 42 and provides one approach to influx detection. For example, the tank 42 can hold a generally constant volume of mud during operations. The trip tank 44 and tank 42 can be arranged such that when the return rate of mud suddenly increases and surpasses the pumping rate of mud into the petroleum well, the trip tank 44 will accumulate mud. During normal operations, the trip tank 44 can be empty or less full than the tank 44. Also, the trip tank 44 can be smaller than the tank 42 making spikes in the level of mud easier to detect.

Figure 2:
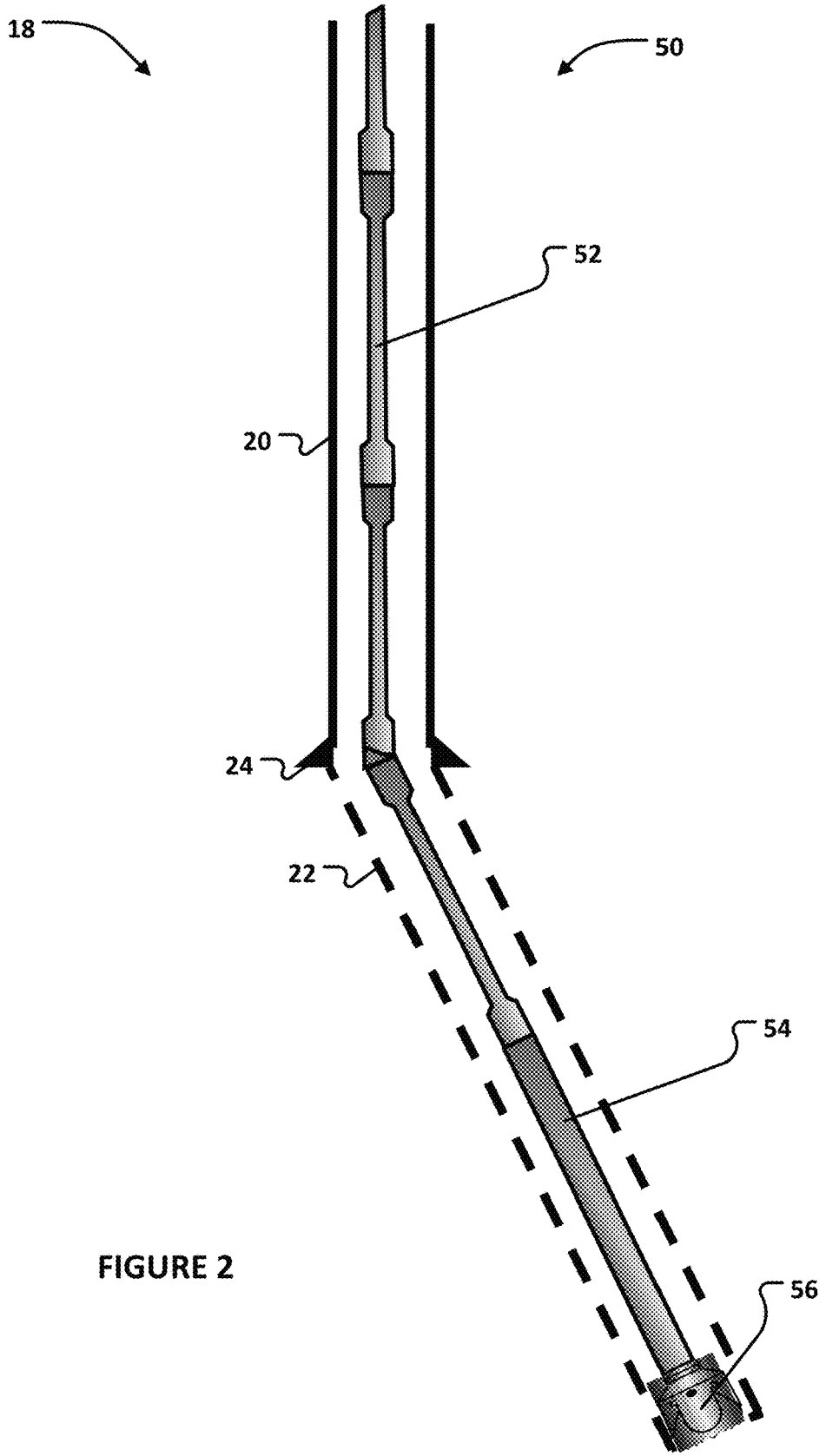
FIG. 2 is a sectional view through the petroleum well showing drilling structures positioned in the wellbore.

The components of a drilling apparatus 50 are shown in FIG. 2. The drilling apparatus 50 can include a plurality of drilling pipe sections, such the section referenced at 52, interconnected to one another for concurrent rotation. The drilling apparatus 50 can also include a collar 54 and a bit 56. Drilling mud is directed through the drilling apparatus 50, downward, passes out of the collar 54 at the bit 56, and returns the surface in the annular space around the drilling apparatus 50. An influx can intrude in the petroleum well 18 as the bit 56 is penetrating deeper and can be received in the annular space around the drilling apparatus 50. The intrusion is detected at the surface since the volume of the influx will displace a similar volume of mud. In other words, when the influx intrudes in the petroleum well, the flow rate of mud into the system becomes less than the flow rate of mud out of the system. This can also be manifested in the trip tank or tanks as an increase in tank volume after an influx has been taken.

The computing device 12 can selectively control the fluid pressure in the petroleum well 18 by controlling the choke valve 28 and the mud pump 46. For example, the computing device 12 can selectively increase pressure throughout the fluid system by decreasing the opening defined by the choke valve 28 and maintaining a pumping rate of the mud pump 46. Alternatively, the computing device 12 can selectively decrease pressure throughout the fluid system by increasing the opening defined by the choke valve 28 and maintaining a pumping rate of the mud pump 46. The computing device 12 can thus regulate a pressure of the mud proximate to a surface of the petroleum well 18. The system 10 can include a pressure sensor 18 at the surface in electronic communication with the computing device 12 and the computing device 12 can control the choke valve 28 in response to signals received from the pressure sensor 58 and in accordance with instructions stored on medium 16.

When the intrusion of an influx is detected, the computing device 12 can increase the system fluid pressure to control movement of the influx along the petroleum well. The pressure of the mud proximate to the surface of the petroleum well 18 will rise to a first level of surface back pressure by the computing device 12 controlling the choke valve 28. The pressure can be increased until the input mud flow rate is equal to the output mud flow rate. As set forth above, the computing device 12 can communicate with the flowmeter 28 to detect output mud flow rate and communicate with a flow meter associated with the mud pump 46 to determine output mud flow rate.

The computing device 12 can also determine the volume of the influx that has intruded the petroleum well 18. The computing device 12 can monitor the volume of flow through the flowmeter 30 over the period of time during which the pressure is increased in order to bring about equality of the input and output mud flow rates. This volume of flow generally corresponds to the volume of the influx.

The computing device 12 can also ascertain the depth of the bit 46 in the petroleum well 18 when the intrusion of the influx is detected. This depth is herein referred to as the intrusion depth. The rig's data system measures and reports the current well depth by simply calculating how many sections of drill pipe are in the hole at any given time.

The computing device 12 can also control the managed pressure drilling system 10 to evacuate the influx from the petroleum well 18 through the managed pressure drilling system 10 in response to a correlation between both of the first level of surface back pressure and the volume of the influx relative to the intrusion depth. In the present disclosure, traditional oilfield units are used. Pressure is in pounds per square inch (psi), volumes in barrels (bbl), depth and lengths are in feet (ft), diameters in inches, temperatures are in Rankine, and densities are in pounds per gallon (ppg).

Figures 3, 4, 5:
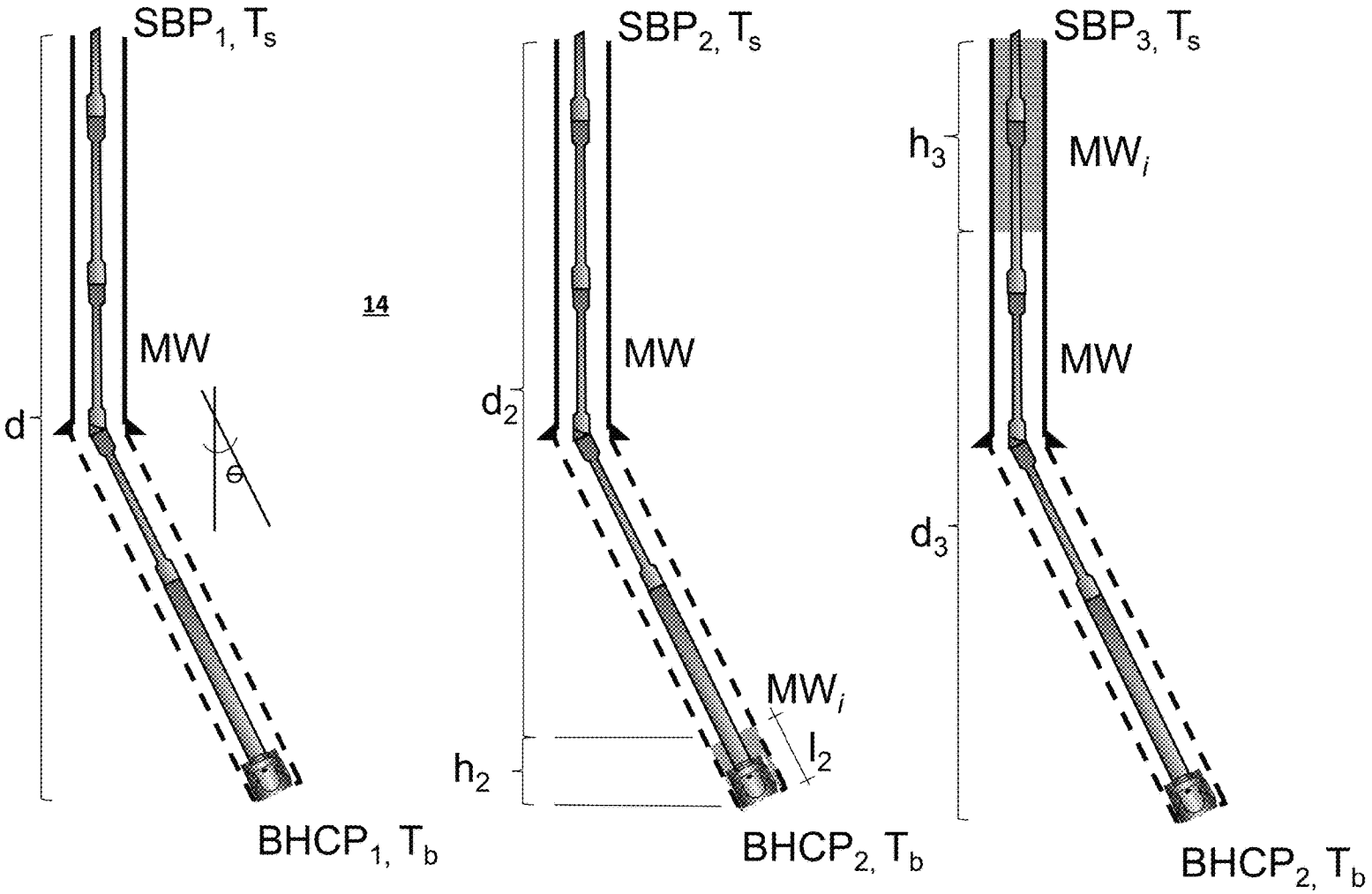
FIG. 3 is a view including the structures shown in FIG. 2 and further including indicia to indicate the physical natures/positions of various physical properties and/or dimensions prior to the intrusion of an influx in the petroleum well.
FIG. 4 is a view including the structures shown in FIG. 2 and further including indicia to indicate the physical natures/positions of various physical properties and/or dimensions after the intrusion of the influx in the petroleum well and the rise of surface back pressure to control the influx.
FIG. 5 is a view including the structures shown in FIG. 2 and further including indicia to indicate the physical natures/positions of various physical properties and/or dimensions after the influx has moved to the surface of the petroleum well.

Reference is now made to FIGS. 3-5. As set forth above, when the intrusion of the influx is detected, the surface back pressure (SBP) can be raised to control the influx and this will cause a rise in a bottom hole circulating pressure (BHCP). BHCP will be raised to a pressure greater than the pressure inherent in the influx. BHCP is dependent on SBP, as will be set forth below. When the intrusion of an influx is detected, SBP is raised from $SBP_1$ prior to intrusion of the influx to a first level of surface back pressure, referred to as $SBP_2$. As a result, the BHCP rises from $BHCP_1$ prior to intrusion of the influx to $BHCP_2$ as a result of the rise of SBP from $SBP_1$ to $SBP_2$.

$BHCP_2$ is made up of the following:

$$BHCP_2=P_{s2}+P_{f2}+SBP_2$$

where $P_{s2}$ is the annular static pressure and $P_{f2}$ is the annular friction pressure. The annular static pressure $P_{s2}$ is made up of the weight of each of fluids in the annulus:

$$P_{s2}=P_{sm2}+P_{si2}$$

wherein $P_{sm2}$ is the component of the annular static pressure arising due to the mud and $P_{si2}$ is the component of the annular static pressure arising due to the influx.

The annular friction pressure $P_{f2}$ is made up of friction arising due to each of fluids in the annulus:

$$P_{f2}=P_{fm2}+P_{fi2}$$

wherein $P_{fm2}$ is the component of the annular static pressure arising due to the mud and $P_{f2}$ is the component of the annular static pressure arising due to the influx. The friction component of the influx ($P_{fi2}$) can assumed to be small relative to the friction component of the mud and can therefore be discarded.

The static pressure ($P_{s2}$) is therefore:

$$P_{s2}=(MW*d_2*0.052)+(MW_i*h_2*0.052)$$

where MW is the mud weight or density of the mud, $d_2$ is the height of the mud column, $MW_i$ is the density of the influx, and $h_2$ is the vertical height of the influx. MW is known because the material used for the mud is chosen by the rig operator. The influx can be a liquid or a gas. A gas influx is most problematic. Therefore, the influx can be presumed to be a gas and $MW_i$ is thus 2 lbs/gal. It is noted that the value 0.052 is applied since it is a conversion factor between the various units. Thus, the density of the respective mud weights, in pounds per gallon, is converted to a value of pressure in pounds per square inch by the equation in the paragraph immediately above (namely, $P_{s2}=(MW*d_2*0.052)+(MW_i*h_2*0.052)$). $h_2$ is not known, but as set forth below, will drop out of the analysis. Since the height of the mud column ($d_2$) is not known, the equation can be written terms of the influx height $h_2$ and the overall depth d, since d is known at any point in time by the rig operator and $d=h_2+d_2$. Further, the height $h_2$ of the influx may also be written in terms of its length ($l_2$) in an inclined wellbore:

$$h_2=l_2*\cos(\theta)$$

Rearranging the equation for the annular static pressure $P_{s2}$ in view of these considerations results in:

$$P_{s2}=0.052(MW*d+((l_2*\cos(\theta))(MW_i-MW))$$

Note that for a horizontal well, the inclination (θ) is 90°, the cosine of which is zero (0). In such a case, as the "height" of an influx along a horizontal wellbore is insignificant relative to the overall depth of the well, this term goes to zero and the static weight is entirely due to the mud column.

Further substitution can be made with respect to the equation for $BHCP_2$:

$$BHCP_2=0.052(MW*d+((l_2*\cos(\theta))(MW_i-MW)))+P_{fm2}+SBP_2$$

When the influx reaches the surface, referenced in some of the variables by the subscript "3," the BHCP need not change. In one or more embodiments of the present disclosure, BHCP at the time the influx reaches the surface is $BHCP_2$. Thus, BHCP can be maintained at a bottom of the well 18 at a substantially constant level during the circulating of the influx. BHCP at the time the influx reaches the surface is comprised of both the annular static and frictional components of both the mud and the influx as well as the resultant surface back pressure. However, the SBP can change from $SBP_2$ when the influx reaches the surface, rising to $SBP_3$. With particular reference to FIG. 3, the equation for $BHCP_2$ thus becomes:

$$BHCP_2=(MW_i*h_3*0.052)+(MW*d*0.052)-(MW*h_3*0.052)+P_{fm3}+P_{fi3}+SBP_3$$

The first component of the equation immediately above, ($MW_i*h_3*0.052$), represents the effect on $BHCP_2$ by the volume of the influx at the surface. $h_3$ is the height of the influx when the influx reaches surface and can be solved for as set forth below. The second and third components of the equation immediately above, (MW*d*0.052) and ($MW*h_3*0.052$), represent the effect on $BHCP_2$ by the volume of the mud. The fourth and fifth components of the equation immediately above, $P_{fm3}$ and $P_{fi3}$, represent the effect on $BHCP_2$ by the annular friction pressure $P_{f3}$ which is made up of friction arising due to each of fluids (mud and influx) in the annulus. The friction component of the influx ($P_{fi3}$) can assumed to be small relative to the friction component of the mud and can therefore be discarded.

When the equations set forth in preceding paragraphs, specifically $BHCP_2=0.052\ (MW*d+((l_2*\cos(\theta))(MW_i-MW)))+P_{fm2}+SBP_2$ as well as the equation $BHCP_2=(MW_i*h_3*0.052)+(MW*d*0.052)-(MW*h_3*0.052)+P_{fm3}+P_{fi3}+SBP_3$, are considered jointly, $h_3$ can be determined:

$$h3=(SBP3-SBP2-(0.052*l_2*\cos(\theta)*(MW_i-MW))+P_{fm2}-P_{fm3})/((MW-MW_i)*0.052)$$

The equation can be further refined by recasting the influx lengths $l_2$ and $h_3$ as volumetric terms. The influx occupies the annular space between the drilling pipe sections 52 and the open hole 22 and/or casing wall 20. The volume $V_2$, in barrels (bbls), that the influx occupies at the bottom of the hole when first detected is:

$$V2=(((ID_2)^2-(OD_2)^2)/(1029.4))*l_2$$

where $ID_2$ is the borehole diameter in inches, $OD_2$ is the bore hole annulus or the drill pipe outer diameter in inches, $l_2$ is the length in feet. The value 1029.4 is the conversion factor between inches to pounds. It is noted that the equation immediately above can be solved for $l_2$.

A similar equations can be solved for $h_3$:

$$h_3=V3*((1029.4)/((ID_2)^2-(OD_2)^2))$$

However, it is noted that the ID and OD at the surface should be applied in the equation immediately above is different than $ID_2$ and $OD_2$. If the diameters are different, the ID and OD can be designated as $ID_3$ and $OD_3$. The component of the equation $((ID_2)^2-(OD_2)^2)$ can be designated as $(D_2)^2$.

The Combined Gas Law can be applied to convert V3 to V2:

$$(P_2*V_2)/T_2=(P_3*V3)/T_3$$

$P_2$ is $BHCP_2$. V2 will have been determined, as set forth above. $T_2$ is the temperature $T_b$, the temperature at the bottom of the hole. $T_b$ can be detected by sensors of the drilling equipment. $P_3$ is $SBP_3$, such as sensor 60 in FIG. 1. $T_3$ is the temperature $T_s$, the temperature at the surface. $T_s$ can be detected by sensors in the drilling equipment, such as sensor 62 in FIG. 1.

Recasting the equation to solve for V3, the volume of the influx when it reaches the surface, yields:

$$V3=(BHCP_2*V2*T_s)/(SBP_3*T_b)$$

It is noted that the pressure within the petroleum well 18 decreases the closer to the surface. Therefore, the influx can expand since less pressure is being applied to contain the influx. V3 as defined in the equation set forth immediately above can be applied in a paragraph above (namely, $h_3=V3*((1029.4)/((ID_2)^2-(OD_2)^2)))$ for $h_3$, thus defining $h_3$ in terms of V2. As set forth in the equation at a paragraph above (namely $V2=(((ID_2)^2-(OD_2)^2)/(1029.4))*l_2$), $l_2$ can also be defined in terms of V2.

Applying the equation defining $h_3$ in terms of V2 and the equation defining $l_2$ in terms of V2 with the equation set forth in a paragraph above (namely, $h_3=(SBP_3-SBP_2-(0.052*l_2*\cos(\theta)*(MW_i-MW))+P_{fm2}-P_{fm3})/((MW-MW_i)*0.052))$ will allow for the determination of V2:

$$V2=[(SBP_3-SBP_2+P_{fm2}-P_{fm3})/53.53]*[(D_2*D_3*SBP_3*T_b)/((MW-MW_i)*((BHCP_2*T_s*D_2)-(\cos(\theta)*D_3*SBP_3*T_b)))]$$

It is noted that the equation above yields a maximum acceptable value for the influx. The actual value of V2 can be determined by the managed pressure drilling system 10 when the influx is detected. The actual value of V2 can be determined based on monitoring the rates of fluid in and fluid out of the well over the period of time that the SBP is raised from the initial, pre-influx level of $SBP_1$ to post-influx level $SBP_2$. This actual value V2 is hereafter referred to as $V2_{act}$. The paragraphs above detail an algorithm for determining a maximum acceptable value of V2, the maximum acceptable value of V2 representing the largest V2 that can be evacuated from the system by the managed pressure drilling system. It is noted that $SBP_3$ is a predetermined value and represents that capacity or limit of the managed pressure drilling system 10. This maximum acceptable value V2 is hereafter referred to as $V2_{max}$. The equation set forth above in the paragraph immediately above (namely, $V2=[(SBP_3-SBP_2+P_{fm2}-P_{fm3})/53.53]*[(D_2*D_3 \quad SBP_3*T_b)((MW-MW_i)*((BHCP_2*T_s*D_2)-(\cos(\theta)*D_3*SBP_3*T_b)))])$ thus allows the user to determine $V2_{max}$. The computing device 12 can compare $V2_{max}$ with $V2_{act}$ and, if $V2_{act}$ is less than $V2_{max}$, can evacuate the influx through the primary barrier equipment 26 of the managed pressure drilling system 10.

It has been found that dropping the frictional pressure terms $P_{fm2}-P_{fm3}$ from the equation set forth in a paragraph above (namely, $V2=[(SBP_3-SBP_2+P_{fm2}-P_{fm3})/53.53]*[(D_2*D_3*SBP_3*T_b)/((MW-MW_i)*((BHCP_2*T_s*D_2)-(\cos(\theta)*D_3*SBP_3*T_b)))])$ results in a more conservative, and perhaps more desirable, maximum acceptable value $V2_{max}$. Dropping the friction pressure terms also addresses the operational issue of stopping the pumps during influx circulation for whatever reason. Note, however, that friction remains inherently a part of the equation as $BHCP_2$ is a circulating pressure, not a static one.

If $V2_{act}$ is less than $V2_{max}$ in view of the depth d, the influx can thus be directed through the primary barrier equipment 26 of the managed pressure drilling system 10 in response at least partially to the intrusion depth d. Further, drilling operations can be maintained between the detecting and the evacuating; this continuation of operations occurs at least partially in response to both of the volume of the influx as well as the intrusion depth. The secondary barrier equipment 32 of the managed pressure drilling system 10 can thus be bypassed in the evacuating of the influx, this in response at least partially to both of the first level of surface back pressure $SBP_2$ as well as the intrusion depth d.

Further, as set forth, directing the influx through a primary barrier equipment 26 of the managed pressure drilling system 10 also occurs in response at least partially to a height of the influx in the petroleum well when the influx reaches the surface. The height need not be directly determined, but can be represented by other variables. The height of the influx in the petroleum well when the influx reaches the surface is also relevant to determining $V2_{max}$, despite not being determined directly. Also, the open hole diameter of the petroleum well 18, the temperature of the mud at the surface, the temperature of the mud at a bottom of the petroleum well 18, the mud weight of the mud, and the inclination of the wellbore are also considered in determining V2max.

Figure 6:
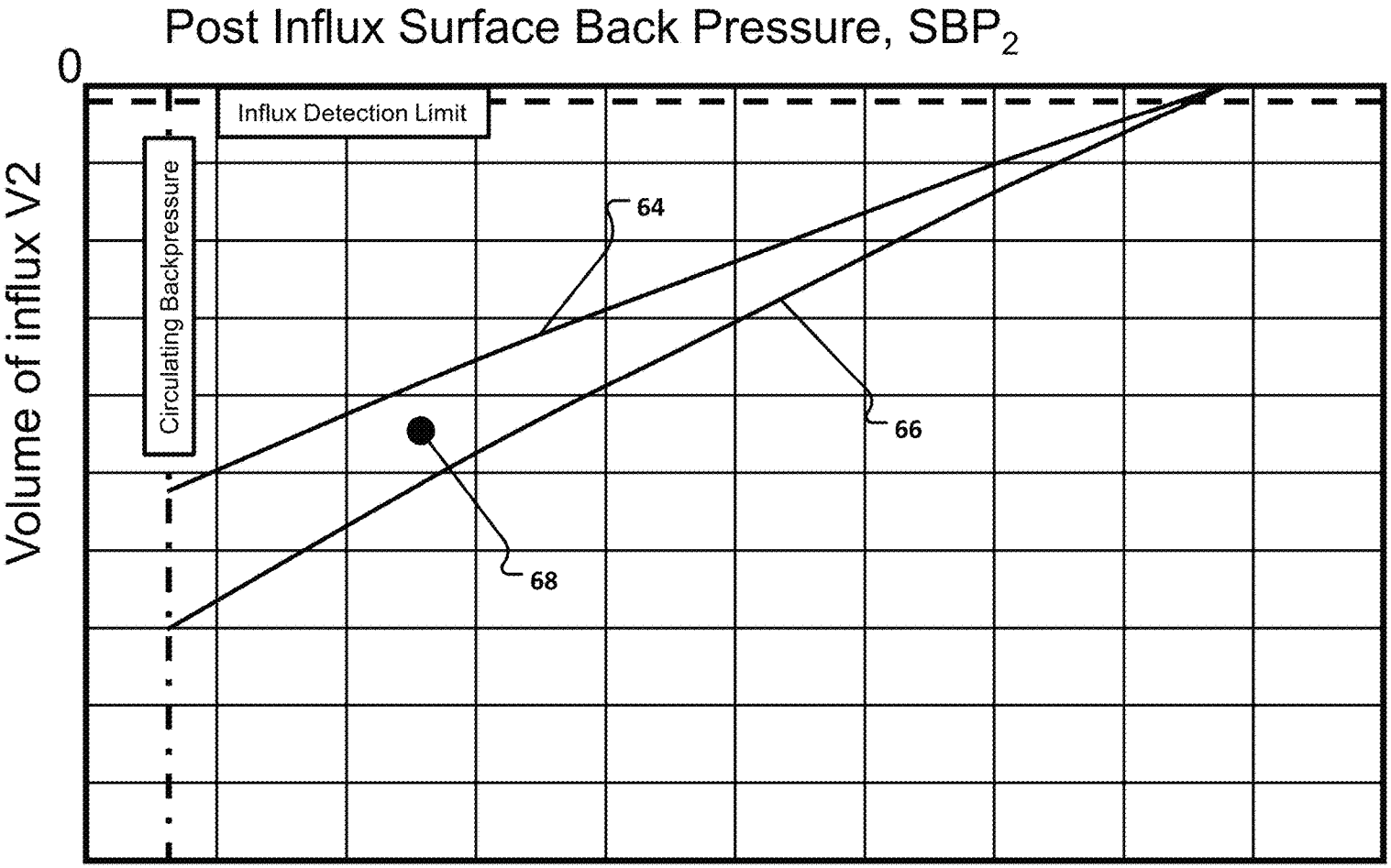
FIG. 6 is a graph showing a correlation between both of the first level of surface back pressure and the volume of the influx relative to the intrusion depth.

FIG. 6 is an exemplary graph showing the effect of the correlation between both of the first level of surface back pressure ($SBP_2$) and the volume of the influx V2 relative to the intrusion depth d. In the graph, the vertical axis represents $V2_{max}$. The value of $V2_{max}$ increases with downward distance from the origin (the value is not negative). The horizontal axis represents the first level of surface back pressure $SBP_2$) required to control the influx. The value of $SBP_2$ increases with distance to the right from the origin.

Numerical values for an exemplary embodiment of the present disclosure are set forth below. These numerical values are for illustration only and are not limiting to the present disclosure. The numeric values provided herein can be helpful for developing exemplary embodiments of the present disclosure when considered relative to one another.

For example, the numeric values may represent a relatively small embodiment of the present disclosure. In a relatively large embodiment of the present disclosure, one or more of the numeric values provided herein may be multiplied as desired. Also, different operating environments for one or more embodiments of the present disclosure may dictate different relative numeric values.

A first curve is referenced at 64. The first curve 64 defines a boundary between acceptable and unacceptable volumes V2 at a first well depth. A second curve is referenced at 66. The second curve 66 defines a boundary between acceptable and unacceptable volumes V2 at a second well depth. The second well depth is greater than the first well depth. For example, the second well depth could be 13,776 ft. and the first well depth could be 9,676 ft. Acceptable volumes V2 are defined above the respective curves and unacceptable volumes V2 are defined below the respective curves.

Point 68 represents an influx event. For example, a particular influx intruded the petroleum well 18. The influx was found to have an actual volume $V2_{act}$ of thirty 30 bbl influx and 400 psi was required at the surface ($SBP_2$) to control the influx. If the influx occurred at the second well depth, V2 of the influx is acceptable and the computing device 12 would control the other components of the system 10 to evacuate the influx through the primary barrier equipment 26. If the same influx occurred at the first well depth, V2 of the influx is unacceptable and the computing device 12 would control the other components of the system 10 to evacuate the influx through the secondary barrier equipment 32. Generally, in the exemplary embodiment, with increasing depth, increasing lower volumes of influx are acceptable.

Figure 7:
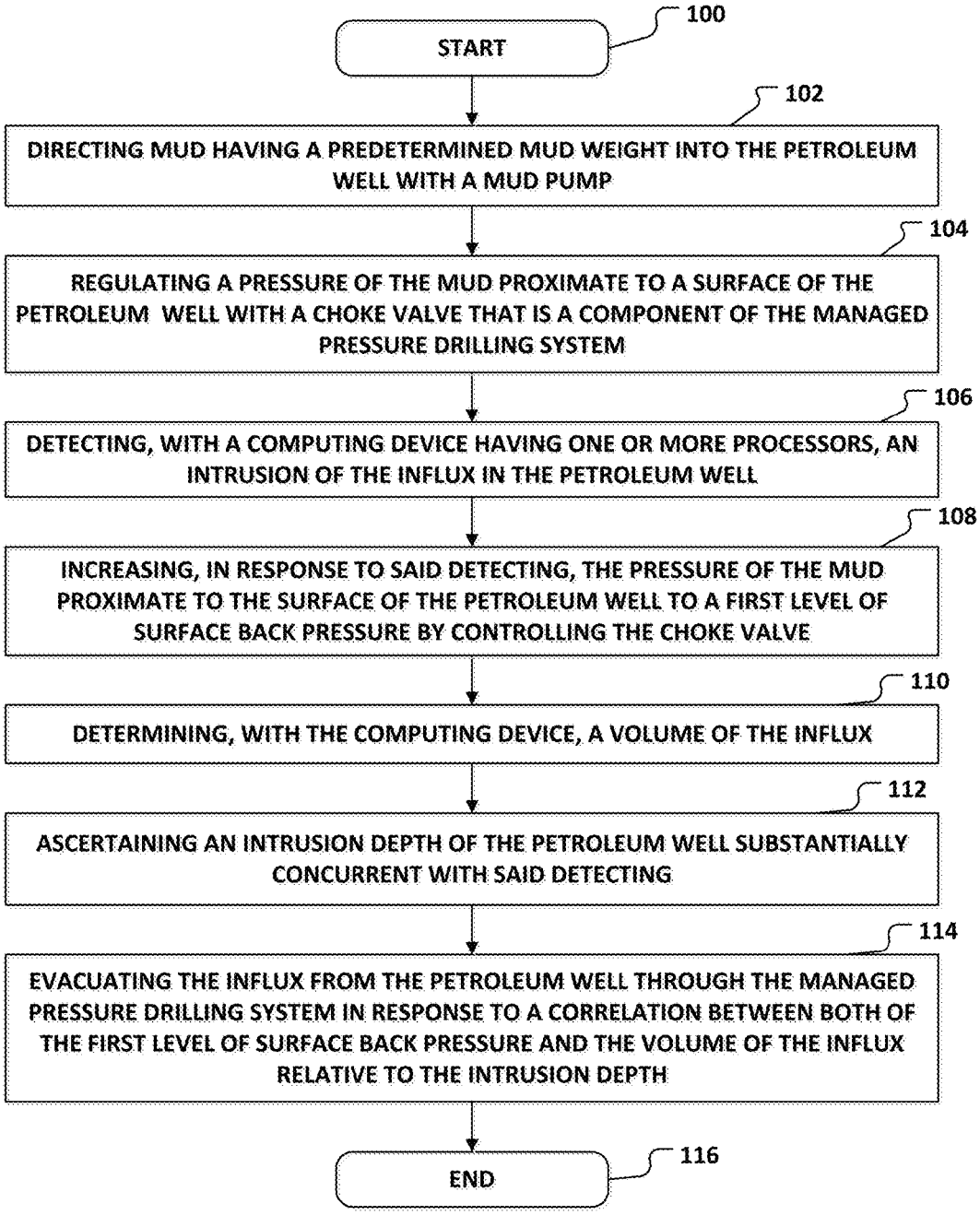
FIG. 7 is a flow diagram of an example method according to some implementations of the present disclosure.

FIG. 7 is a flow chart illustrating an exemplary method that can be carried out in some embodiments of the present disclosure. The process starts at step 100. At step 102, mud having a predetermined mud weight can be directed into the petroleum well 18 with a mud pump 46. For example, the computing device 12 can control the mud pump 46 to operate in accordance with instructions stored on medium 16.

At step 104, the pressure of the mud proximate to a surface of the petroleum well 18, referred to above as SBP, can be regulated with the choke valve 28 that is a component of the managed pressure drilling system 10. For example, the computing device 12 can control the fluid pressure in the system, including the surface back pressure, by controlling the choke valve 28 and the mud pump 46 in accordance with instructions stored on medium 16.

At step 106, the computing device 12 can detect the intrusion of the influx in the petroleum well 18. For example, the computing device 12 can monitor flow rates of fluid in and fluid out of the petroleum well 18 and, in accordance with instructions stored on medium 16, recognize excess fluid out as corresponding to the intrusion of an influx.

At step 108, in response to the detecting of the intrusion of the influx, the pressure of the mud proximate to the surface of the petroleum well can be increased to a first level of surface back pressure ($SBP_2$) by controlling the choke valve 28. For example, the computing device 12 can increase the fluid pressure in the system, including the surface back pressure, by at least partially closing the choke valve 28 in accordance with instructions stored on medium 16.

At step 110, the computing device 12 can determine a volume of the influx. For example, the computing device 12 can monitor the volume of flow through the flowmeter 30 over the period of time during which the pressure is increased in order to bring about equality of the input and output mud flow rates. This volume of flow generally corresponds to the volume of the influx.

At step 112, an intrusion depth of the petroleum well can be ascertained substantially concurrent with the detecting.

At step 114, the influx can be evacuated from the petroleum well through the managed pressure drilling system in response to a correlation between both of the first level of surface back pressure and the volume of the influx relative to the intrusion depth. The process ends at 116.

It is noted that other embodiments of the present disclosure can apply different equations and can also apply to standard rigs (non-MPD arrangements).

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein as other present disclosures in other patent documents is hereby unconditionally reserved.

What is claimed is:

1. A method of controlling an influx in a petroleum well with a managed pressure drilling system comprising:

directing mud having a predetermined mud weight into the petroleum well with a mud pump;

regulating a pressure of the mud proximate to a surface of the petroleum well with a choke valve that is a component of the managed pressure drilling system;

detecting, with a computing device having one or more processors, an intrusion of the influx in the petroleum well;

increasing, in response to said detecting, the pressure of the mud proximate to the surface of the petroleum well to a first level of surface back pressure by controlling the choke valve whereby an input flow rate of the mud to the managed pressure drilling system is equalized to an output flow rate of the mud from the managed pressure drilling system;

determining, with the computing device, a volume of the influx;

ascertaining an intrusion depth of the petroleum well substantially concurrent with said detecting; and evacuating the influx from the petroleum well through the managed pressure drilling system in response to a correlation between both of the first level of surface back pressure and the volume of the influx relative to the intrusion depth; and wherein said evacuating further comprises:

determining, with the computing device, a volume of the influx if both (a) the influx were to reach the surface and (b) equalization of the input flow rate of the mud and output flow rate of the mud was maintained when the influx reaches the surface;

determining, with the computing device, a second level of surface back pressure that correspond to the equalization of the input flow rate of the mud and output flow rate of the mud was maintained when the influx reaches the surface; and comparing, with the second level of surface back pressure against a maximum level of surface back pressure of the managed pressure drilling system.

2. The method of claim 1 wherein said evacuating further comprises:

directing the influx through a primary barrier equipment of the managed pressure drilling system in response at least partially to the intrusion depth.

3. The method of claim 1 further comprising:

maintaining drilling operations between said detecting and said evacuating in response at least partially to both of the volume of the influx as well as the intrusion depth.

4. The method of claim 1 wherein said evacuating further comprises:

bypassing a secondary barrier equipment of the managed pressure drilling system in said evacuating of the influx in response at least partially to both of the first level of surface back pressure as well as the intrusion depth.

5. The method of claim 1 wherein said evacuating further comprises:

directing the influx through a primary barrier equipment of the managed pressure drilling system in response at least partially to a height of the influx in the petroleum well when the influx reaches the surface.

6. The method of claim 1 further comprising:

determining a height of the influx in the petroleum well when the influx reaches the surface.

7. The method of claim 1 further comprising:

circulating the influx through the petroleum well with the managed pressure drilling system; and maintaining a circulating pressure at a bottom of the well at a substantially constant level during said circulating.

8. The method of claim 1 wherein said evacuating further comprises:

directing the influx through a primary barrier equipment of the managed pressure drilling system in response at least partially to the intrusion depth.

9. The method of claim 1 further comprising:

increasing the pressure of the mud proximate to the surface of the petroleum well to a second level of surface back pressure greater than the first level of surface back pressure by controlling the choke valve in response to the influx reaching the surface.

10. The method of claim 9 wherein said evacuating further comprises:

directing the influx through a primary barrier equipment of the managed pressure drilling system in response at least partially to the second level of surface back pressure.

11. The method of claim 1 wherein said evacuating further comprises:

directing the influx through a primary barrier equipment of the managed pressure drilling system in response at least partially to an open hole diameter of the petroleum well.

12. The method of claim 1 wherein said evacuating further comprises:

directing the influx through a primary barrier equipment of the managed pressure drilling system in response at least partially to a temperature of the mud at the surface of the petroleum well.

13. The method of claim 1 wherein said evacuating further comprises:

directing the influx through a primary barrier equipment of the managed pressure drilling system in response at least partially to a temperature of the mud at a bottom of the petroleum well.

14. The method of claim 1 wherein said evacuating further comprises:

directing the influx through a primary barrier equipment of the managed pressure drilling system in response at least partially to the predetermined mud weight of the mud.

15. The method of claim 1 wherein said evacuating further comprises:

directing the influx through a primary barrier equipment of the managed pressure drilling system in response at least partially to an inclination of a wellbore of the petroleum well.

16. A managed pressure drilling system configured to control an influx in a petroleum well and comprising:

a computing device having one or more processors and a non-transitory, computer readable medium storing instructions that, when executed by the one or more processors, cause the computing device to perform operations comprising:

directing mud having a predetermined mud weight into the petroleum well with a mud pump;

regulating a pressure of the mud proximate to a surface of the petroleum well with a choke valve that is a component of the managed pressure drilling system;

detecting, with a computing device having one or more processors, an intrusion of the influx in the petroleum well;

increasing, in response to said detecting, the pressure of the mud proximate to the surface of the petroleum well to a first level of surface back pressure by controlling the choke valve whereby an input flow rate of the mud to the managed pressure drilling system is equalized to an output flow rate of the mud from the managed pressure drilling system;

determining, with the computing device, a volume of the influx;

ascertaining an intrusion depth of the petroleum well substantially concurrent with said detecting;

evacuating the influx from the petroleum well through the managed pressure drilling system in response to a correlation between both of the first level of surface back pressure and the volume of the influx relative to the intrusion depth; and wherein the evacuating further comprises:

determining, with the computing device, a volume of the influx if both (a) the influx were to reach the surface and (b) equalization of the input flow rate of the mud and output flow rate of the mud was maintained when the influx reaches the surface;

determining, with the computing device, a second level of surface back pressure that correspond to the equalization of the input flow rate of the mud and output flow rate of the mud was maintained when the influx reaches the surface; and comparing, with the second level of surface back pressure against a maximum level of surface back pressure of the managed pressure drilling system.

17. The managed pressure drilling system of claim 16 wherein said non-transitory, computer readable medium stores instructions that, when executed by the one or more processors, cause the computing device to perform said evacuating to further comprise:

directing the influx through a primary barrier equipment of the managed pressure drilling system in response at least partially to the intrusion depth.

18. The managed pressure drilling system of claim 16 wherein said non-transitory, computer readable medium stores further instructions that, when executed by the one or more processors, cause the computing device to perform the operation comprising:

maintaining drilling operations between said detecting and said evacuating in response at least partially to both of the volume of the influx as well as the intrusion depth.

19. The managed pressure drilling system of claim 16 wherein said non-transitory, computer readable medium stores instructions that, when executed by the one or more processors, cause the computing device to perform said evacuating to further comprise:

bypassing a secondary barrier equipment of the managed pressure drilling system in said evacuating of the influx in response at least partially to both of the first level of surface back pressure as well as the intrusion depth.

20. One or more non-transitory computer-readable media having instructions stored thereon, wherein the instructions, in response to execution by a device, cause the device to:

direct mud having a predetermined mud weight into a petroleum well with a mud pump;

regulate a pressure of the mud proximate to a surface of the petroleum well with a choke valve that is a component of a managed pressure drilling system;

detect, with a computing device having one or more processors, intrusion of an influx in the petroleum well;

increase, in response to detection of the influx, the pressure of the mud proximate to the surface of the petroleum well to a first level of surface back pressure by controlling the choke valve whereby an input flow rate of the mud to the managed pressure drilling system is equalized to an output flow rate of the mud from the managed pressure drilling system;

determine, with the computing device, a volume of the influx;

ascertain an intrusion depth of the petroleum well substantially concurrent with detection of the influx;

evacuate the influx from the petroleum well through the managed pressure drilling system in response to a correlation between both of the first level of surface back pressure and the volume of the influx relative to the intrusion depth; and wherein the evacuation further comprises:

determining, with the computing device, a volume of the influx if both (a) the influx were to reach the surface and (b) equalization of the input flow rate of the mud and output flow rate of the mud was maintained when the influx reaches the surface;

determining, with the computing device, a second level of surface back pressure that correspond to the equalization of the input flow rate of the mud and output flow rate of the mud was maintained when the influx reaches the surface; and comparing, with the second level of surface back pressure against a maximum level of surface back pressure of the managed pressure drilling system.

* * * * *